US006870529B1

(12) United States Patent
Davis

(10) Patent No.: US 6,870,529 B1
(45) Date of Patent: Mar. 22, 2005

(54) SYSTEM AND METHOD FOR ADJUSTING DISPLAY BRIGHTNESS LEVELS ACCORDING TO USER PREFERENCES

(75) Inventor: Kevin Davis, Suwanee, GA (US)

(73) Assignee: NCR Corporation, Dayton, OH (US)

( * ) Notice: Subject to any disclaimer, the term of this patent is extended or adjusted under 35 U.S.C. 154(b) by 283 days.

(21) Appl. No.: 10/109,500

(22) Filed: Mar. 28, 2002

(51) Int. Cl.[7] ..... G09G 5/00

(52) U.S. Cl. ..... 345/207; 345/690; 715/745; 715/747; 348/602

(58) Field of Search ..... 345/690, 204, 345/207, 211, 212, 745, 747, 750; 348/602; 715/745, 747, 750

(56) References Cited

U.S. PATENT DOCUMENTS 4,760,389 A 7/1988 Aoki et al.
5,029,982 A 7/1991 Nash
5,153,756 A 10/1992 Ike
5,157,525 A 10/1992 Eaton et al.
5,270,818 A 12/1993 Ottenstein
5,406,305 A 4/1995 Shimomura et al.
5,554,912 A 9/1996 Thayer et al.
5,760,760 A 6/1998 Helms
5,818,553 A 10/1998 Koenck et al.
5,952,992 A * 9/1999 Helms ..... 345/102
6,094,185 A * 7/2000 Shirriff ..... 345/102
6,256,019 B1 * 7/2001 Allport ..... 345/169
6,618,045 B1 * 9/2003 Lin ..... 345/207

* cited by examiner

*Primary Examiner*—Henry N. Tran
(74) *Attorney, Agent, or Firm*—Maginot Moore & Beck LLP; Paul W. Martin

(57) ABSTRACT

A display brightness monitoring system associates a brightness level and an ambient light level with a user identifier. Ambient light signals are received from an ambient light sensor mounted in proximity of an electronic display. Brightness levels are received from a brightness control mechanism for user selection of a display brightness. The monitoring system collects brightness levels and associates them with one of the ambient light levels associated with a user identifier. Preferably, a plurality of brightness levels are collected for each ambient light level and are used to compute a preferred brightness level indicative of a user's preferred display brightness for a given ambient light level. The brightness levels may be statistically averaged for computation of the brightness level. A data structure for associating brightness levels with ambient light levels and associating ambient light levels with a user identifier may be used to segregate one user's brightness levels from those of another. In this manner, the display may be driven using the preferred brightness levels for the user authorized to use a computer without altering the brightness levels stored for other users.

22 Claims, 3 Drawing Sheets

SYSTEM AND METHOD FOR ADJUSTING DISPLAY BRIGHTNESS LEVELS ACCORDING TO USER PREFERENCES

FIELD OF THE INVENTION

This invention relates generally to ergonomic controls for personal computers and, more particularly, to brightness level controls for personal computers.

BACKGROUND OF THE INVENTION

Displays are important components of computers as they provide visual data for interaction with computer users. In computer systems that use CRTs or the like, the voltage that is used to accelerate electrons towards the phosphor dots of the screen surface determines the intensity, or brightness, of the display. In portable computers, liquid crystal displays (LCD) or the like are illuminated by a backlight to enhance contrast and increase the visibility of what is displayed. The intensity or brightness of a computer display is typically adjustable by a user. This adjustment is important for computer users because all users do not have the same quality of eyesight. Specifically, some users are more light sensitive and reduce the brightness of the display so the glare of the screen does not irritate their eyes. Others require greater brightness so they can clearly see what is displayed on the screen without squinting or straining their eyes. Consequently, most computer displays include variable switches so users may increase or decrease the display brightness depending upon the needs of their eyes.

One factor that contributes to the need for adjusting the brightness of a display is the ambient light level of the environment where a user views the screen. In ambient light of low intensity, users probably prefer lower brightness levels for the display as most can view the screen adequately at a relatively low brightness level for the display. To address the need to adjust the display brightness according to ambient light changes, systems have been developed to sense ambient light levels and adjust the display brightness level accordingly. Adjustment of display brightness level in response to ambient light changes is especially important for computers that are powered by a battery source. A substantial portion of the energy drained from a battery is used to illuminate the display. Thus, operation of the display at the lowest acceptable level for ambient light conditions significantly improves the battery life for a portable computer. A system for adjusting display brightness with reference to ambient light is disclosed in U.S. Pat. No. 5,760,760. The system of the '760 patent includes one or more light sensors for determining an ambient light level and adjusting the brightness of the display to a predetermined brightness level that improves the length of battery life. The patent also teaches that the system may include a neural network for "learning" user-defined brightness levels for ambient light range so that the user-defined brightness levels may be used to override the predetermined brightness level. This learning may "take into account" previous user-defined brightness levels and may adjust the display brightness level accordingly.

While the '760 patent addresses the issue of ambient light changes and the "learning" of user-defined brightness levels that differ from the predetermined brightness levels, it fails to account for the differences in the eyesight of different users. If the previous user for a computer is different than the current user of a computer then the system of the '760 patent will combine the level selected by the current user with that selected by the previous user and "learn" that level. If the previous user had relatively weak eyesight, the brightness level is probably appreciably greater than that selected by a user having stronger eyesight. Consequently, the level "learned" is a level that is adequate for neither the first or the second user. That is, the system of the '760 patent assumes the user remains the same and that typically is not true of the use of many computers.

What is needed is a system that can adjust the brightness level of a computer display to a level that corresponds to the eyesight of a current user.

SUMMARY OF THE INVENTION

A system and method that operates in accordance with the principles of the present invention overcome the above-noted limitations of brightness level control systems. The system of the present invention comprises an ambient light sensor, a brightness level control mechanism, and a brightness level monitor for associating a current user identifier with a current brightness level and a current ambient light level. The ambient light sensor generates a signal indicative of the ambient light level in the environment in which the computer display is located. The brightness level control mechanism generates a brightness level signal for a computer display. The brightness level monitor is coupled to the ambient light sensor and the brightness level control mechanism to receive the ambient light level signal and the brightness level signal. The values corresponding to these signals are then stored in association with a user identifier that uniquely identifies the current user of the computer system.

In response to either an ambient light change or a brightness level signal change that exceeds some threshold, a new ambient light level and a new brightness level value are associated with the user identifier. In this manner, a brightness level for each ambient light level defined by a threshold may be stored in association with a current user identifier. Also, multiple brightness levels for the same ambient light level range may be weighted, averaged, or otherwise mathematically combined to produce a brightness level that may be associated with a current user identifier. Additionally, a plurality of brightness levels may be associated with a single ambient light level for a user identifier and the last associated brightness level used to adjust the display brightness until a statistically significant number of samples are collected. Then, a preferred user brightness level may be computed using the collected samples and the preferred user brightness level may be used to adjust the display brightness. The next brightness level for that particular ambient light level may then replace the oldest sample and the preferred user brightness level re-computed with the updated set of samples. Thus, the system of the present invention may be used to store a brightness level for each ambient light level sensed during a user session and also to compute a brightness level for storage in response to multiple brightness levels being set at the same ambient light level. When the user terminates the session, ambient light values and brightness levels are no longer associated with a user identifier so the stored values are not altered by environmental light changes that may occur.

The user identifier of the present invention may be a user name or password such as a character string, a fingerprint, other biometric identifier, or the like. The data of the user identifier may be used as a field in a database record or as some other type of storage label so at least one ambient light level may be stored in association with the user identifier. If multiple ambient light levels are sensed during a user's computer session, a brightness level is associated with each ambient light level sensed during the session and stored in association with the user identifier. As other users log onto the computer, ambient light levels and corresponding brightness levels are stored in association with the user identifier for the current user. Once brightness levels have been established for multiple ambient light levels for a user, subsequent sessions may result in modification of the brightness levels associated with one or more ambient levels. In response to ambient light level changes, the brightness level control mechanism may receive brightness levels from the brightness level monitor to set the display brightness level at user preferred levels. Thus, the system of the present invention segregates the preferred user brightness levels of users from one another so the preferred user brightness level associated with a particular ambient light level correlates with the preferences of the current computer user.

The method of the present invention includes receiving an ambient light level, receiving a display brightness level, and associating the ambient light level and the display brightness level with a user identifier corresponding to a current user of a computer system. The ambient light level may be received from an ambient light sensor and the display brightness level may be received from a brightness level control mechanism. The method may include associating the ambient light level, display brightness level, and the user identifier in a data record that may be stored in a relational database. Alternatively, the ambient light level, display brightness level, and the user identifier in a data record may be associated in a data object that may be stored in an object repository. The method may also include retrieving a brightness level corresponding to an ambient light level and associated with a user identifier and sending the retrieved brightness level to the brightness control mechanism to set the display brightness level. The method may also compute a brightness level for a particular ambient light level from a plurality of brightness levels received at the ambient light level for the current computer user.

It is an object of the present invention to segregate the brightness levels for one computer user from those of another computer user.

It is an object of the present invention to combine different brightness levels at a particular ambient light level to adjust preferred brightness levels for a user on a historical basis.

It is an object of the present invention to enable display brightness control that corresponds to individual user preferences.

These and other advantages and features of the present invention may be discerned from reviewing the accompanying drawings and the detailed description of the invention.

BRIEF DESCRIPTION OF THE DRAWINGS

The present invention may take form in various system and method components and arrangement of system and method components. The drawings are only for purposes of illustrating an exemplary embodiment and are not to be construed as limiting the invention.

DETAILED DESCRIPTION OF THE INVENTION

Figure 1:
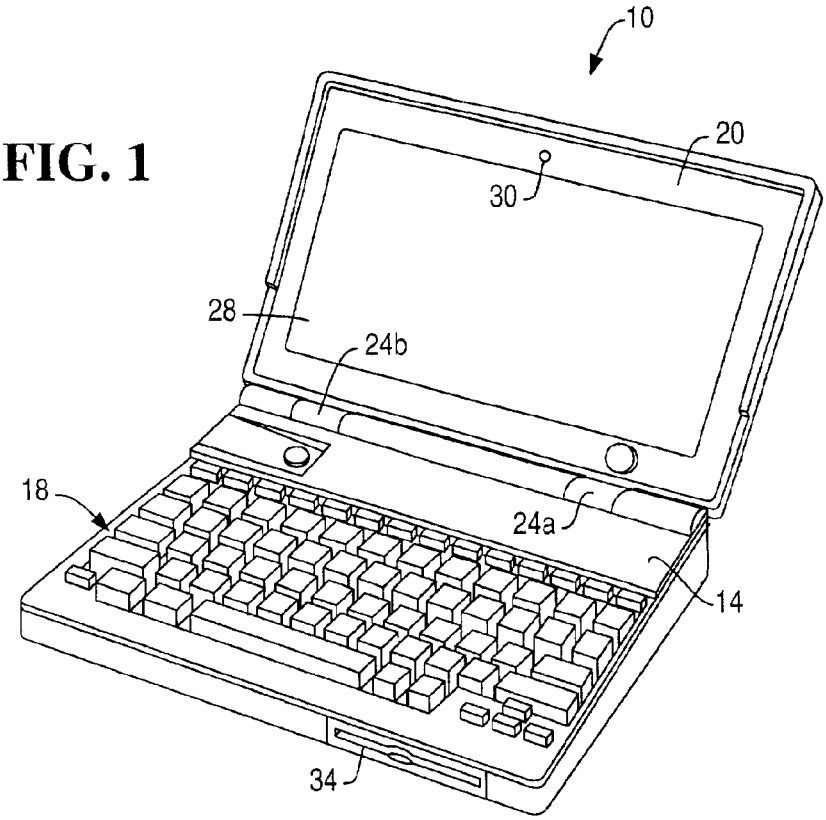
FIG. 1 is a front perspective view of a portable personal computer in which the system of the present invention may be used.

A portable personal computer in which the present invention may be used is shown in FIG. 1. The computer shown in FIG. 1 is exemplary as the system and method of the present invention may be used with a stand alone computer stations that are not portable. Computer 10 includes a housing 14 with a keyboard 18 to which a display cover 20 is attached by means of a hinges 24*a* and 24*b*. Mounted with display cover 20 is a display screen 28 that may be a liquid crystal display (LCD). The driver for display 28 is typically located in housing 14 and coupled to display 28 through circuitry that extends from housing 14 to cover 20. Mounted within the periphery of cover 20 or housing 14 is an ambient light sensor 30 that generates a signal indicative of the ambient light level falling on the display and/or housing of computer 10. Computer 10 typically also has an external storage unit 34 such as a hard disk, diskette drive, CD-ROM drive or a combination thereof.

Figure 2:
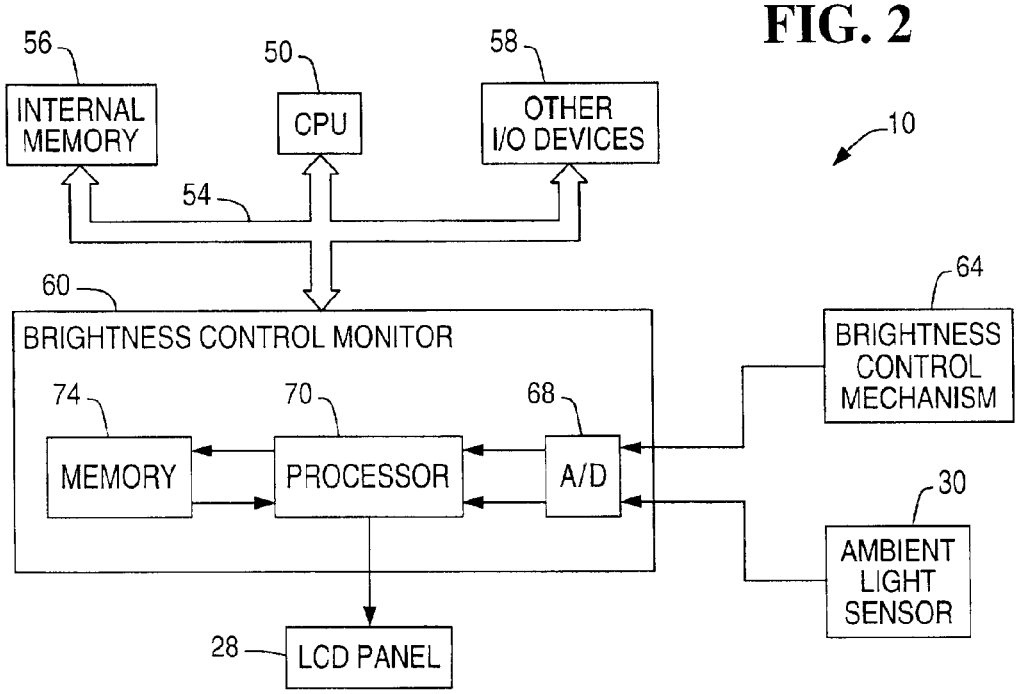
FIG. 2 is a block diagram of the computer shown in FIG. 1.

Internal components of computer 10 are shown in FIG. 2. Bus 54 couples central processing unit (CPU) 50 to internal memory 56 and other input/output (I/O) devices 58. Bus 54 also couples CPU 50 to a brightness control monitor 60. Brightness control monitor 60 is coupled to a brightness control mechanism 64 and ambient light sensor 30. Brightness control mechanism 64 may be a rotary or sliding switch or it may be comprised of a function key and directional keys within keyboard 18. Brightness control mechanism 64 generates a brightness level signal that may be processed by brightness control monitor 60. Analog/digital (A/D) converter 68 may be used to convert the signals from ambient light sensor 30 and/or brightness control mechanism 64 for use by brightness control monitor 60. Preferably, microprocessor 70 is the controller of the display driver for display 28, although a dedicated processor or application specific integrated circuit (ASIC) may be used. Volatile/non-volatile memory 74 may contain the programmed instructions for performing the method of the present invention with the components of brightness control monitor 60 as well as being available for data storage. Microprocessor 70 is also coupled to display 28 to control the brightness level of the display. In the case of an LCD display, microprocessor 70 controls the intensity of the backlight while in other display types, microprocessor controls the energy of the sweeping beam used to generate a display.

Figure 3:
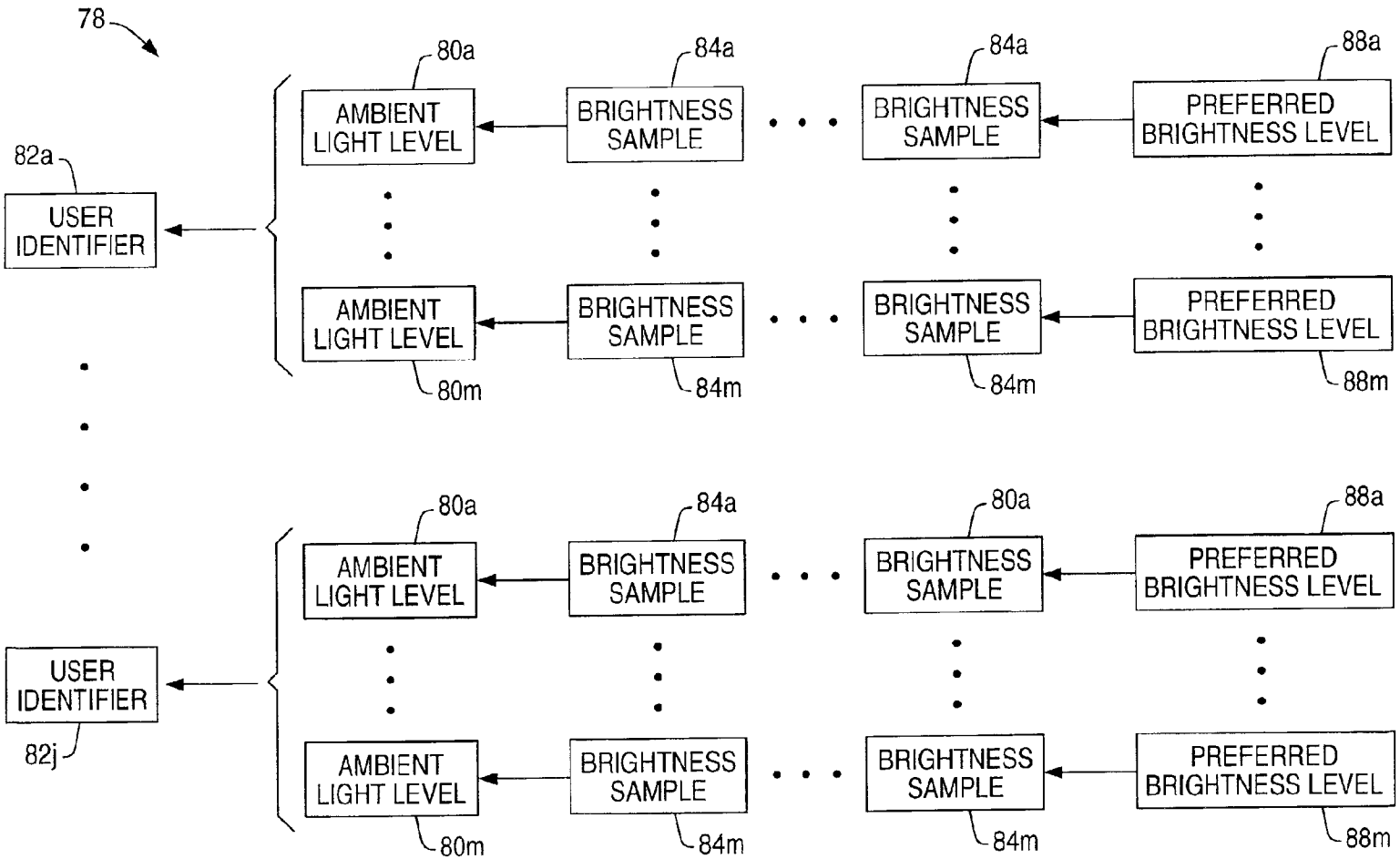
FIG. 3 is a block diagram of a data structure that may be used to associate a current user identifier with an ambient light level and one or more brightness levels.

Brightness control monitor 60 obtains a user identifier for a user currently utilizing computer 10 from CPU 50 or one of the I/O devices on bus 54. The ambient light level is read from ambient light sensor 30 and the brightness level is read from brightness control mechanism 64. The brightness level is associated with the ambient light level for the current user in a data structure 78 such as that one shown in FIG. 3. A plurality of ambient light levels 80*a*-80*m* are associated with one of the user identifiers 82*a*-82*j*. The ambient light levels may be expressed as percentages of maximum brightness and equally separated from one another or the spacing between levels may be non-linear. A threshold may be defined to provide a range about each ambient light level so that ambient light levels not exactly equal to one of the ambient light levels for a user may be correlated to the ambient light level for the range in which the ambient light levels lie. A plurality of brightness levels 84*a*-84*m* are associated with each ambient light level. The brightness levels 84*a*-84*m* are samples that may be used to compute a preferred user brightness level 88*a*-88*m* that may be associated with each ambient light level. Before all of the samples are collected for an ambient light level, the latest brightness level received from mechanism 64 may be used to drive display 28 or a weighted average of the samples currently collected may be used. Once all of the samples are collected, a weighted or other statistical average may be used to calculate a preferred user brightness level. The preferred user brightness level may be used to drive display 28 and stored as a preferred user brightness level 88*a*-88*m* in data structure 78 in one of the ambient light levels 80*a*-80*m* for the current user. The next collected brightness sample for an ambient light level may be used to overwrite the oldest stored sample and update the computed preferred user brightness level for that ambient light level.

Figure 4:
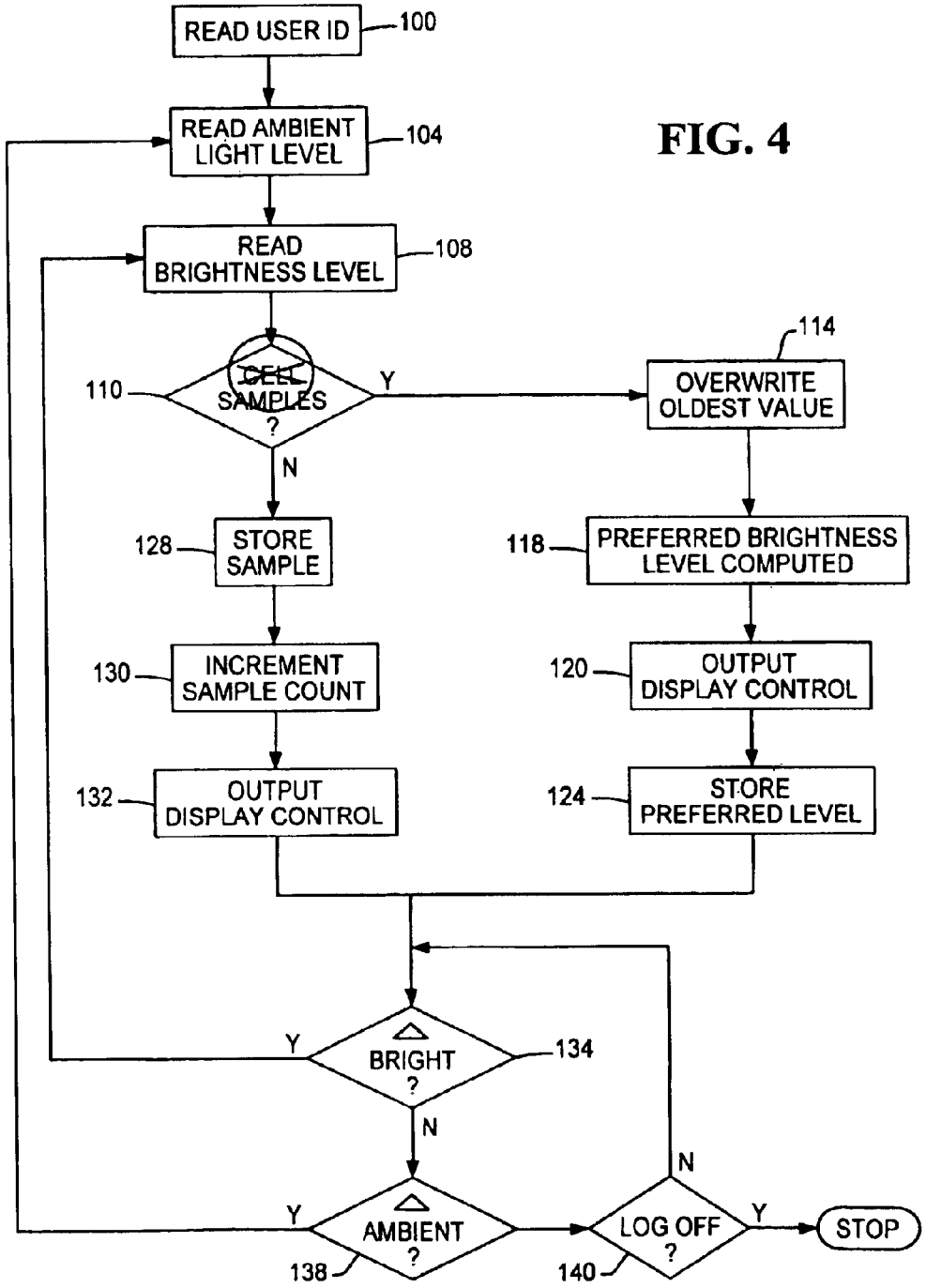
FIG. 4 is a flowchart of an exemplary method for associating brightness levels with particular ambient light levels for a current user identifier.

An exemplary method of the present invention that associates brightness levels with ambient light levels for a current user is shown in FIG. 4. The method of FIG. 4 begins by reading the user identifier of the user currently authorized to utilize computer 10 so the data structure for the current user may be retrieved (block 100). The ambient light level is read from ambient light sensor 30 (block 104) and the corresponding ambient light level in the data structure accessed. The brightness level is read from brightness control mechanism 64 (block 108) and a determination is made as to whether the complete number of samples as been collected (block 110). If the number of samples is complete, the oldest sample is overwritten with the newest brightness level (block 114), the preferred brightness level is computed (block 118), and sent to display 28 for adjustment of the display brightness level (block 120). The preferred user brightness level is stored for the corresponding ambient light level (block 124).

If the full number of samples is not collected (block 110), the sample is stored at the next available sample location (block 128) and the sample count is incremented (block 130). The sample is sent to the display driver to control display brightness or the sample may be averaged with the samples collected at that point and the average used to control display brightness (block 132). Ambient light sensor 30 and brightness control mechanism 64 are monitored for readings that exceed some threshold over the last read levels (blocks 134, 138). If the brightness level exceeds the brightness threshold, the new brightness level is read (block 108) and a determination is made regarding the number of samples collected (block 110). The process continues as explained above. If the ambient light level exceeds the ambient threshold, a new ambient light level for the current user is accessed (block 104) and the process continues as explained above. Finally, should a user terminate the current session (block 140), the process is terminated so further brightness levels are collected and used to drive display 28.

While the present invention has been illustrated by the description of an exemplary process and system components, and while the process and various components have been described in considerable detail, the applicant does not intend to restrict or in any limit the scope of the appended claims to such detail. For example, the system and method of the present invention may be used in any electronic device having a display for which brightness control is available. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A system for associating a brightness level and an ambient light level with an identifier for a currently authorized user comprising:

an ambient light sensor for generating an ambient light level signal corresponding to a current ambient light level on a display;

a brightness control mechanism for generating a display brightness level signal corresponding to a current display brightness level; and a brightness level monitor for associating the current ambient light level and the current display brightness level with an identifier for a user currently authorized to access a computer.

2. The system of claim 1 wherein the brightness control mechanism is one of a rotary and sliding switch.

3. The system of claim 1 wherein the brightness control mechanism includes a function key and directional keys of a keyboard.

4. The system of claim 1 wherein the brightness level monitor associates current display brightness levels for a plurality of different user identifiers.

5. The system of claim 1 wherein the brightness level monitor associates a plurality of brightness level samples with each ambient light level associated with a user identifier.

6. The system of claim 5 wherein the brightness level monitor generates a preferred brightness level for each of the ambient light levels associated with the user identifier.

7. The system of claim 6 wherein the brightness level monitor generates the preferred brightness level from a plurality of brightness samples for each of the ambient light levels associated with the user identifier.

8. The system of claim 7 wherein the brightness level monitor statistically averages the plurality of brightness samples to compute the preferred brightness level.

9. A method for associating a brightness level and an ambient light level with an identifier for a user currently authorized to access a computer comprising:

receiving an ambient light level signal indicative of a current ambient light level on a display;

receiving a brightness level signal indicative of a current brightness level for controlling brightness of the display; and associating the current ambient light level and the current brightness level with the user identifier.

10. The method of claim 9 further including:

associating a plurality of different ambient light levels with the user identifier.

11. The method of claim 10 further including:

collecting a plurality of brightness levels for each ambient light level.

12. The method of claim 10 further including:

associating the collected plurality of brightness levels with each ambient light level.

13. The method of claim 11 further comprising:

computing a preferred brightness level from the plurality of brightness levels associated with one of the ambient light levels.

14. The method of claim 12 wherein the preferred brightness level computation includes statistically averaging the plurality of brightness levels associated with the one ambient light level.

15. The method of claim 11 further comprising:

terminating the collection of brightness levels in response to the user currently authorized to access the computer logging off.

16. A system for associating a brightness level and an ambient light level with an identifier for a currently authorized user comprising:

means for generating an ambient light level signal corresponding to a current ambient light level on a display;

means for generating a display brightness level corresponding to a current display brightness level; and means for associating the ambient light level and the display brightness level with the identifier.

17. The system of claim 16 further comprising:

means for associating brightness levels for a plurality of different user identifiers.

18. The system of claim 16 further comprising:

means for associating a plurality of brightness level samples with each ambient light level associated with a user identifier.

19. The system of claim 16 further comprising:

means for generating a preferred brightness level for an associated ambient light level.

20. The system of claim 19 wherein the display brightness generating means further includes:

means for statistically averaging the plurality of brightness samples to compute the preferred brightness level.

21. A system for adjusting brightness of a display comprising:

an ambient light sensor for generating an ambient light level signal corresponding to a current ambient light level on the display;

a brightness control mechanism for generating a brightness level signal indicative of a current brightness level of the display;

a brightness control monitor for associating the current ambient light level with a stored ambient light level associated with a user currently authorized to access a computer driving the display, for determining a preferred brightness level out of a plurality of stored brightness levels associated with the stored ambient light level, for determining that the current brightness level is different from the preferred brightness level by at least a predetermined threshold, and for adjusting the brightness of the display to the preferred brightness level.

22. A method of adjusting brightness of a display comprising the steps of:

receiving an ambient light level signal indicative of a current ambient light level on a display;

receiving a brightness level signal indicative of a current brightness level of the display;

associating the current ambient light level with a stored ambient light level associated with a user currently authorized to access a computer driving the display;

determining a preferred brightness level out of a plurality of stored brightness levels associated with the stored ambient light level;

determining that the current brightness level is different from the preferred brightness level by at least a predetermined threshold; and adjusting the brightness of the display to the preferred brightness level.

* * * * *